US007798982B2

(12) United States Patent
Zets et al.

(10) Patent No.: US 7,798,982 B2
(45) Date of Patent: Sep. 21, 2010

(54) METHOD AND APPARATUS FOR GENERATING A VIBRATIONAL STIMULUS

(75) Inventors: Gary A. Zets, Winter Park, FL (US); Thomas H. Ensign, Winter Park, FL (US); Frank D. Chapman, Winter Park, FL (US); Bruce J. P. Mortimer, Winter Park, FL (US)

(73) Assignee: Engineering Acoustics, Inc., Casselberry, FL (US)

( * ) Notice: Subject to any disclaimer, the term of this patent is extended or adjusted under 35 U.S.C. 154(b) by 836 days.

(21) Appl. No.: 11/187,395

(22) Filed: Jul. 22, 2005

(65) Prior Publication Data

US 2006/0015045 A1 Jan. 19, 2006

Related U.S. Application Data

(63) Continuation-in-part of application No. 10/290,759, filed on Nov. 8, 2002, now abandoned.

(51) Int. Cl.
*A61H 1/00* (2006.01)

(52) U.S. Cl. ..... 601/78; 601/46

(58) Field of Classification Search ..... 601/79, 601/80, 81, 82, 87, 46, 48, 49, 78; 310/14, 310/15, 20, 21, 30
See application file for complete search history.

(56) References Cited

U.S. PATENT DOCUMENTS 1,962,747 A * 6/1934 Malby ..... 601/78
2,077,425 A * 4/1937 Lieber ..... 381/151
3,984,708 A * 10/1976 Holmlund et al. ..... 310/30
4,779,615 A * 10/1988 Frazier ..... 601/47
5,002,065 A * 3/1991 LaCourse et al. ..... 600/552
5,184,332 A * 2/1993 Butler ..... 367/162
5,195,532 A * 3/1993 Schumacher et al. ..... 600/552
5,245,989 A * 9/1993 Simon ..... 601/138
5,424,592 A * 6/1995 Bluen et al. ..... 310/28
6,087,942 A * 7/2000 Sleichter et al. ..... 340/576
6,146,342 A * 11/2000 Glen ..... 601/61
6,264,621 B1 * 7/2001 Paske ..... 600/587
6,693,516 B1 * 2/2004 Hayward ..... 340/407.1

* cited by examiner

*Primary Examiner*—Tatyana Zalukaeva
*Assistant Examiner*—Rachel T Young
(74) *Attorney, Agent, or Firm*—Hayworth, Chaney & Thomas, P.A.; Stephen C. Thomas; Kelly G. Swartz

(57) ABSTRACT

A vibrotactile transducer provides a point-like vibrational stimulus to the body of a user in response to an electrical input. The apparatus includes a housing held in contact with the skin and a moving mechanical contactor protruding through in an opening in said housing and preloaded into skin. The contactor is attached to a torroidal moving magnet assembly suspended by springs in a magnetic circuit assembly consisting of a housing containing a pair of electrical coils. The mass of the magnet/contactor assembly and the compliance of the spring are chosen so that the electromechanical resonance of the motional masses, when loaded by a typical skin site on the human body, are in a frequency band where the human body is most sensitive to vibrational stimuli. By varying the drive signal to the vibrotactile transducer and activating one or more transducer at specific location on the body using an appropriate choice of signal characteristics and/or modulation, different information can be provided to a user in a intuitive, body referenced manner.

32 Claims, 6 Drawing Sheets

METHOD AND APPARATUS FOR GENERATING A VIBRATIONAL STIMULUS

This application is a continuation-in-part of U.S. Utility patent application Ser. No. 10/290,759, filed Nov. 8, 2002 now abandoned.

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to vibrators, transducers, and associated apparatus, and more specifically to an improved method and apparatus for generating a vibrational stimulus to the body of a user in response to an electrical input.

BACKGROUND INFORMATION/DISCUSSION OF RELATED ART INCLUDING INFORMATION DISCLOSED UNDER 37 CFR 1.97 AND 37 CFR 1.98

The sense of feel is not typically used as a man-machine communication channel, however, it is as acute and in some instances as important as the senses of sight and sound, and can be intuitively interpreted (e.g., think of one's response to being tapped on the shoulder). Using an intuitive body-referenced organization of vibrotactile stimuli, information can be communicated to a user. Military/industrial applications include improved situation awareness to operators of high performance equipment and weapon platforms. Consumer applications include conveying tactile information from a video game and supplementing audio/visual output with tactile sensations related to movies and music.

Tactile stimuli provides a silent and invisible, yet reliable and easily interpreted communication channel, using the human's sense of touch. A single vibrotactile transducer can be used for a simple application such as an alert. A plurality of vibrotactile transducers can be used to provide more detailed information, such as spatial orientation of the person relative to some external reference. Such vibrotactile displays have been shown to reduce perceived workload by its ease in interpretation and intuitive nature. Broadly, this field is also known as haptics.

The key to successful implementation of a vibrotactile transducer for the applications described above lies in the ability to convey a strong, localized vibrotactile sensation to the body with compact, lightweight devices that can be held against the user's body without impairing movement or causing discomfort. As such, they should be thin and lightweight, and should be suitable for incorporation in or under clothing. These devices should be electrically and mechanically safe and reliable in harsh environments, and drive circuitry should be compatible with standard digital communication protocols to allow simple interfacing with a controller such as a computer or other digital control system.

Various types of vibrotactile transducers, suitable for providing a tactile stimulus to the body of a user, have been produced in the past. Prior vibrotactile transducers designs have incorporated electromagnetic devices based on a voice coil (loudspeaker or shaker) design, an electrical solenoid design, or a simple variable reluctance design. The most common approach is the use of a small motor with an eccentric mass rotating on the shaft, such as shown in U.S. Pat. No. 3,361,130 and as used in pagers and cellular phones. When implemented as small, wearable devices, these transducers produce only a low level vibrational output, making them difficult to be perceived by a user who is not concentrating on trying to detect the sensation. They also, in general, provide a diffuse type sensation, so that the exact location of the stimulus on the body may be difficult to discern; as such, they might be adequate to provide a simple alert such as to indicate an incoming call on a cellular phone, but would not be adequate to provide spatial information by means of the user detecting variable stimuli from various sites on the body. Typically these devices operate at a single frequency, and cannot be optimized for operating over the frequency range where the skin of the human body is most sensitive to vibrational stimuli. Rotating devices have a particular problem with start up, since they have to rotate up to speed, so there is a delay between activating the device and the vibrational output.

Piezoelectric designs have also been used for vibrotactile transducers, but in general provide very small displacements, resulting in low vibration output unless the device is very large. Devices such as the Optacon, a reading machine for the blind, use an array of piezoceramic bimorph benders to activate a matrix of rods held against the user's fingertip (Linvill, J. G., EEE Trans on Audio and Electro., Vol. AU-17, No. 4, 271-274, 1969.). Again, the tactile stimulus is relatively low, making it only useful on areas of the body that have a low threshold of vibrotactile detection, such as the fingertips. Other piezoceramic approaches have used benders to impart a lateral motion against the skin, but they tend to be easily damped when in contact with the skin, thus reducing their motion and consequently, their detectability.

More recent applications of vibrotactile stimulus have been related to entertainment applications, such as providing vibrational stimulus to reinforce the sound and graphics for video games and theme park rides. These applications use techniques such as blowing a jet of air against the skin, vibrating the entire seat or floor using a subwoofer or shaker type device (such as in Clamme U.S. Pat. No. 5,973,422 and Bluen et al. U.S. Pat. No. 5,424,592), or using other mechanically actuated devices such as electrical solenoids that contact the body through an opening in a seat. While these devices can provide high levels of sensation, they do not meet the requirement addressed by this invention, in that they are large, require high power, and are typically directly mounted to seating or a floor.

The study of mechanical and/or vibrational stimuli on the human skin has been ongoing for many years. Schumacher et al. U.S. Pat. No. 5,195,532 describes a diagnostic device for producing and monitoring mechanical stimulation against the skin using a moving mass contactor termed a "tappet" (plunger mechanical stimulator). A bearing and shaft is used to link and guide the tappet to the skin and means is provided for linear drive by an electromagnetic motor circuit, similar to that used in a moving coil loudspeaker. The housing of the device is large and mounted to a rigid stand and support, and only the tappet makes contact with the skin. The reaction force from the motion of the tappet is applied to a massive object such as the housing and the mounting arrangement. Although this device does have the potential to measure a human subject's reaction to vibratory stimulus on the skin, and control the velocity, displacement and extension of the tappet by measurement of acceleration, the device was developed for laboratory experiments and was not intended to provide information to a user by means of vibrational stimuli nor be implemented as a wearable device.

Electromagnetic transducers such as used in U.S. Pat. No. 5,195,532 are effective mechanisms to produce the required oscillatory motion for a vibrotactile transducer, but are typically large and inefficient. U.S. Pat. Nos. 5,973,422 and 5,424,592 disclose improved configurations of electromagnetic transducers for use as a low-frequency vibrator/shaker. The electromagnetic moving mass transducer configuration described by U.S. Pat. No. 5,973,422 is based on well known mass-spring, force actuator systems, where the ratio of "reciprocating member" or moving mass and the magnet spring constant should be chosen to achieve substantially the square of the radian resonance frequency. This model holds true if the mass of the housing is assumed to be large (relative to the moving mass) and rigid (free of mechanical resonance frequencies). It further neglects the effect of any mechanical load on the reciprocating member, and assumes that there is negligible damping (resistance) applied to the reciprocating member.

U.S. Pat. Nos. 5,973,422 and 5,424,592 thus present shaker or vibrator configurations that provide high force, work well at low frequencies, typically less than 100 Hz, and have minimal or no loading on the reciprocating member (moving mass). As implemented, the transducer in U.S. Pat. No. 5,424,592 is 3 lb. with a 40 Hz resonance, and the transducer in U.S. Pat. No. 5,973,422 is implemented as an 11 lb. device. Both devices are practically implemented as having their housing attached to a massive object (e.g., furniture, floor) and the moving mass is not in direct contact with the a load.

In summary, the prior art describes large, massive, high output force and displacement devices configured as "bass shakers" typically applied to audio-visual applications, and small, low output displacement devices capable of providing only a weak stimulus to the skin of a user. The prior art fails to recognize the design requirements to achieve a small, wearable vibrotactile device that provides strong, efficient vibration performance (displacement, frequency, force) when mounted against the skin load of a human. This is particularly true when considering the requirement to be effective as a lightweight, wearable tactile display (e.g., multiple vibrotactile devices arranged on the body) in a high noise/vibration environment as may be found, for example, in a military helicopter. It is not possible to simply scale the mechanical design configurations of high displacement/force prior art transducers, such as moving mass mechanical actuators, to a frequency range or physical size applicable to wearable tactile vibrator systems since, in a practical, wearable implementation, the mass of the housing will be small, and both the moving member and the housing will be in contact with the skin, violating the design criteria presented for these designs. To achieve a lightweight vibrotactile transducer that is capable of the required vibration level for tactile awareness, the complex-valued mechanical impedance of the load (in this case, the human skin) must be considered and a more complete description of the transducer system must be used. Further, and most importantly, the complex-valued mechanical impedance of the skin load and the required vibration level for tactile awareness determine the optimal selection of housing or stator mass, movable mass and the spring rate of the suspension spring.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

The present invention provides a novel implementation of a dual-moving mass transducer with a physical configuration and design selected for maximum effectiveness in meeting the requirement for a high output displacement, wearable vibrotactile transducer. The term dual moving mass is used herein to denote the fact that the transducer housing is designed to vibrate at a reduced level and substantially out of phase with the moving member (skin contactor) when both the housing face and contactor face are in simultaneous contact with the skin load, making the device practical as a wearable, vibrational transducer, and distinguishing it from prior art designs that fail to address a housing that is lightweight and not attached to a rigid base.

BRIEF SUMMARY OF THE INVENTION

The method and apparatus for generating a vibrational stimulus of this invention provides an improved vibrotactile transducer and associated drive signals and electronics to provide a strong tactile stimulus that can be easily felt and localized by a user involved in various activities, for example flying an aircraft, playing a video game, or performing an industrial work task. Due to the high amplitude and point-like sensation of the vibrational output, the inventive vibrotactile transducer ("tactor") can be felt and localized anywhere on the body, and can provide information to the user in most operating environments. The transducer itself is a small package that can easily be located against the body when installed under or on a garment, or on the seat or back of a chair. The electrical load presented by the transducer is such that the drive electronics are compact, able to be driven by batteries, and compatible with digital (e.g., TTL, CMOS, or similar) drive signals typical of those from external interfaces available from computers, video game consoles, and the like.

A number of drive parameters can be varied. These include amplitude, drive frequency, modulation frequency, and waveshape. In addition single or groups of transducers can be held against the skin, and activated singly or in groups to convey specific sensations to the user.

It is therefore an object of the present invention to provide a new and improved method and apparatus for generating a vibrational stimulus.

It is another object of the present invention to provide a new and improved vibrotactile transducer and associated drive electronics.

A further object or feature of the present invention is a new and improved transducer that can easily be located against the body when installed under or on a garment, or on the seat or back of a chair.

An even further object of the present invention is to provide a novel transducer with drive electronics that are compact, able to be driven by batteries, and compatible with digital drive signals.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
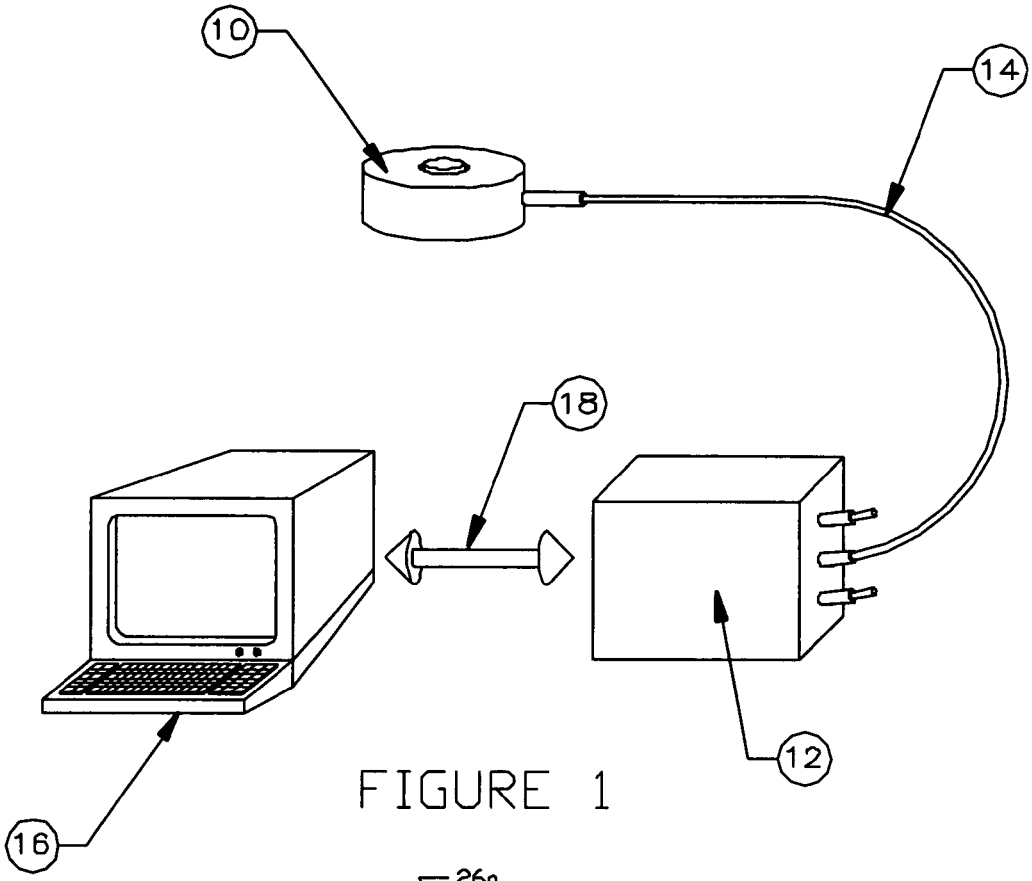
FIG. 1 is a perspective view of a vibrotactile transducer of this invention with its associated controller and driver electronics.

Referring to FIGS. 1 through 13, wherein like reference numerals refer to like components in the various views, there is illustrated therein a new and improved vibrotactile transducer apparatus, generally denominated 10 herein.

FIG. 1 illustrates a first preferred embodiment of the vibrotactile transducer of this invention. A lightweight, physically compact and electrically efficient tactile transducer is herein described that could elicit a localized sensation on the skin. FIG. 1 is an isometric view of a vibrotactile transducer 10 with its associated controller and driver electronics. One or more transducer(s) 10 are connected to controller/driver electronics 12 by connecting cable 14. A computer or other controller 16, for example a portable digital assistant (PDA) may communicate with controller/driver 12 via either a digital bus, analog control lines or wireless interface 18. The driver/external power source may contain a signal synthesizer and linear or switching power amplifier preferably operating in the frequency range of 30 to 300 Hz. The desired sensation is initiated by an input signal waveform stored within the controller 16 or the driver electronics 12, and is amplified and appropriately filtered so that a voltage and current signal is applied to the vibrotactile transducer 10. A typical signal may be a tone burst of a preferred frequency, typically 250 Hz, applied to the tactor, typically in the range of 0.2 to three seconds, to produce a displacement level of greater than 100 micrometers on skin. By varying the drive signal to the tactor and activating one or more tactors at specific location on the body using an appropriate choice of signal characteristics and/or modulation, different information can be provided to a user in a intuitive, body referenced manner.

Figure 2:
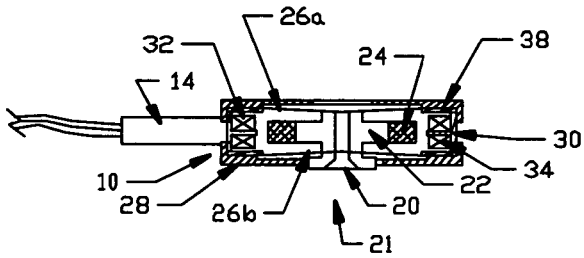
FIG. 2 is a side elevation cross-sectional view of a vibrotactile transducer of this invention showing the torroidal moving magnet assembly and the contactor protruding through an opening in the housing.

FIG. 2 is a side elevation cross-sectional view of a vibrotactile transducer 10. Transducer 10 produces a vibrational stimulus to the body of the user in response to an electrical input. The device 10 includes a housing 38 with a mechanical contactor 20 protruding through an opening 21 in the front face 28 of the housing 38. The front face of the housing and the mechanical contactor are held in simultaneous contact with the user's skin. The contactor is designed to be the predominant moving mass in the system, conducting vibratory motion perpendicular to the surface of the skin and consequently applying a vibrotactile stimulus into a skin load. As the reaction mass, the housing 38 is allowed to vibrate at a reduced level and substantially out of phase with the contactor 20. To account for the elasticity of the skin and/or the layers of clothing between the tactor and the skin, the contactor 20, in its rest position, is raised slightly above the front face 28 of the housing 38. The height of the contactor 20 relative to the front face 28, and the compliance of the springs are chosen so that when the housing and contactor is pressed against the skin of the user, the contactor and magnet assembly are displaced with respect to the housing to simultaneously pre-load the contactor against the skin and the contactor/magnet assembly against the action of the spring. Preferably the height of the contactor 20 relative to the front face 28 should be about 1 mm for appropriate bias preload into the skin or typical skin combined with intermediate layers of clothing.

Figure 3:
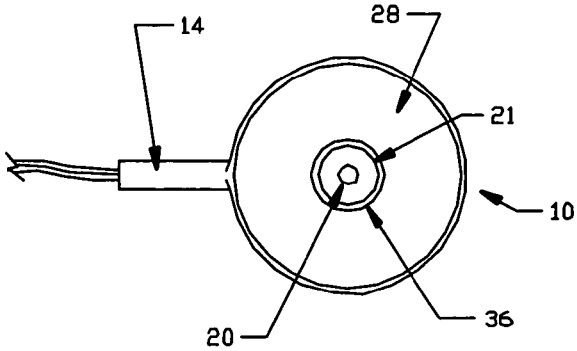
FIG. 3 is a plan view of a vibrotactile transducer of this invention, illustrating the contactor, a radial gap surrounding the contactor, and the housing with skin contacting face.

FIG. 3 is a plan view of a vibrotactile transducer 10 illustrating particular features of this invention. The housing face 28 and the face of the contactor 20 are in simultaneous contact with the skin load. A radial gap 36 results between the opening 21 in the tactor housing and the protruding moving contactor 20. In this configuration, the face 28 of the tactor housing in contact with the skin acts as a passive surround that mechanically blocks the formation of surface waves that otherwise would radiate from the face of the contactor 20 on the surface of the skin when the moving contactor oscillates perpendicularly against the skin. This radial gap and passive surround is beneficial in restricting the area elicited to an area closely approximated by the area of the face of the contactor 10, and therefore meeting the object of creating a localized, point like vibrotactile sensation. The approximately 0.030 inch radial gap 36 between the contactor 20 and the skin contacting face of the housing provides a sharp delineation between vibrating (under the contactor) and minimally-vibrating (under the face of the housing) skin surfaces, a feature that improves tactile sensation.

Referring back to FIG. 2, the contactor 20 is attached to a torroidal moving magnet assembly 22 including magnet 24, suspended by a pair of disc shaped planar springs 26*a*, 26*b* within outer housing 38. The magnet is suspended in a magnetic circuit assembly including a steel housing or coil ring 30 containing a pair of electrical coils 32, 34 connected to electrical cable 14.

The coils 32, 34 are connected in a push-pull configuration. An alternating current is applied to each coil to produce an electromagnetic field in accordance with Amperes's law. Each coil is aligned in the steel coil ring 30 to form a magnetic circuit which provides additive, vector summation of the electromagnetic fields. The steel coil ring 30 further acts to direct and focus the electromagnetic field in the region of the torroidal magnet 22. This moving-magnet, push-pull coil configuration is well known in the art of linear motor actuators and, as implemented in the subject invention, is preferable above single coil configurations in that it results in a more compact and efficient electro magnetic assembly and allows the vibrotactile device 10 to be built with minimal thickness.

In designing a practical wearable vibrotactile device 10, the overall mass of the transducer must be small, preferably less than 100 g. This requirement includes the mass of the contactor, electromagnetic components and housing. The housing should be robust and should facilitate mounting onto a belt, seat, clothes and the like.

Figure 4A:
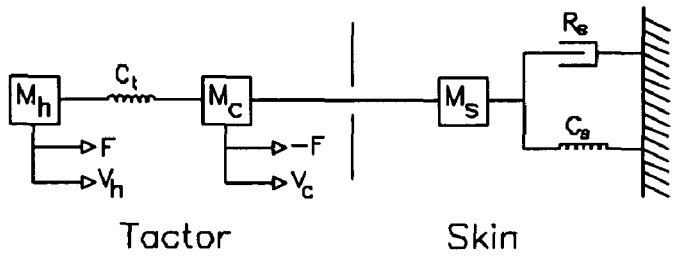
FIG. 4A is a "free-body diagram" description of a transduction model for the dual moving mass vibrotactile device.
Figure 4B:
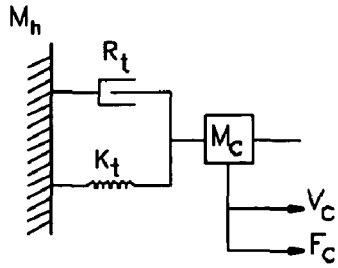
FIG. 4B is a "free-body diagram" of prior art mass spring force actuator systems.
Figure 5:
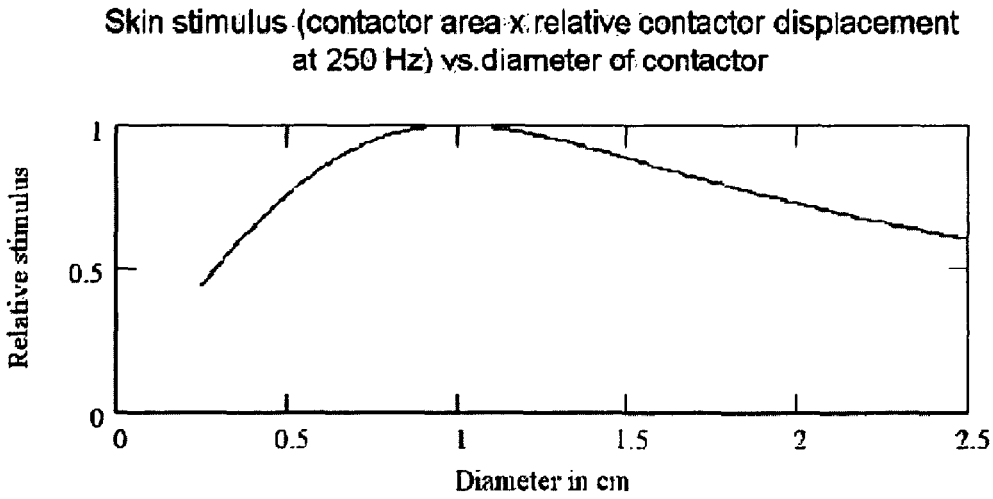
FIG. 5 is a plot of "skin stimulus" against various diameters of contactor.

A description of a transduction model for the dual moving mass vibrotactile device 10 is shown in the "free-body diagram" of FIG. 4A. FIG. 4A is a more complete model for a mass-spring, force actuator systems, and expands on the well know model of FIG. 4B used in prior art where the ratio of the moving mass $M_c$, and the magnet spring constant $K_t$ is used to determine the square of the resonance frequency. The loading effect of the skin against the contactor 20 and housing face 28 and the mechanical parameters such as mass and area are included in the "free-body diagram" model of FIG. 4A. The electromagnetic linear motor in the vibrotactile device 10 generates two equal and oppositely directed forces, one on the contactor-reciprocating magnet assembly, and the other on the tactor housing 28 which contains the coil pairs or stator, and steel coil ring 30. FIG. 4A identifies these forces as F and −F that result from an electrical drive current applied to the motor coils in the housing.

In FIG. 4A the velocity of the housing is represented by Vh, the contactor velocity is Vc, the mass of the tactor housing which contains the motor coils and steel coil ring is Mh, the total suspension spring 26*a* and 26*b* mechanical compliance is Cs, and the contactor-moving mass 20 is Mc. The skin component load on the contactor face comprises mass Ms, mechanical compliance Cs and mechanical resistance Rs. These three mechanical components can be combined in series and represented as an equivalent mechanical impedance load Zh. Numerical values for the skin impedance components can be found in E. K. Franke, *Mechanical Impedance Measurements of the Human Body Surface*, Air Force Technical Report No. 6469, Wright-Patterson Air Force Base, Dayton, Ohio, and T. J. Moore, et al, *Measurement of Specific Mechanical Impedance of the Skin*, J. Acoust. Soc. Am., Vol. 52, No. 2 (Part 2), 1972. These references show that skin tissue has the mechanical input impedance of a fluid-like inertial mass, a spring-like restoring force and a viscous frictional resistance. The numerical magnitude of each component in the skin impedance depends on the area of the contactor and, as can be expected, the resistive loading of the skin is shown to increase with increasing contactor diameter.

The equations of motion for the mechanical circuit of dual mass transducer depicted in FIG. 4A can be written in matrix form as follows:

$$\begin{bmatrix} F \\ -F \end{bmatrix} = \begin{bmatrix} \frac{1}{s.Cs} + s.Mh + Zh & -\frac{1}{s.Cs} \\ -\frac{1}{s.Cs} & \frac{1}{s.Cs} + s.Mc + Zc \end{bmatrix} \cdot \begin{bmatrix} Vh \\ Vc \end{bmatrix} \tag{1}$$

This pair of equations represents the velocities at the housing and the contactor in response to the internal forces generated in the linear motor. The Laplace transform s-parameter has been used to simplify the mechanical impedance terms. A skin-like load impedance Zh and Zc is assumed for the housing and the contactor respectively. Thus complex mechanical properties of the skin, complete mechanical vibrotactile system components and motional parameters are described with this set of equations. Analysis of this system of equations is usually by direct mathematical analysis or using a computer-based equation solver.

Analysis of equation 1 shows that the vibrotactile mechanical system is resonant at two frequencies, the first when the housing velocity is maximum and the second when the contactor velocity is maximum. Housing and contactor displacement are the integral of housing and contactor velocities respectively. In vibrotactile applications, maximum human perception sensitivity depends primarily on contactor displacement, which is the integral of the velocity. Thus the design should be such that the predominant moving mass in the vibrotactile mechanical system should be the contactor 20. For maximum stimulus, the vibrotactile contactor displacement or resonance should preferably be within the frequency range of 200 to 300 Hz, where the skin has it greatest tactile sensitivity (J. S. Bolenowski, *Four Channels Mediate the Mechanical Aspects of Touch*, J. Acoust. Soc. Am. 84, 1691, 1988).

If we define the "skin stimulus" to be the product of the contactor area and the relative contactor displacement, we can solve the equations of motion for the system (equation 1) at 250 Hz and plot "skin stimulus" against various diameters of contactor in cm. This function, shown in FIG. 5 clearly describes a range of contactor diameters that will produce an optimum stimulus. Preferably the optimum vibrotactile contactor diameter into skin load should have a diameter of about 0.95 cm. Specifically, the contactor diameter should be between 0.75 and 1.25 cm.

To be useful, the total mass of the complete vibrotactile transducer must be light enough to be wearable. The magnitude of the force generated by the linear motor within the assembly is known to be directly proportional to the contactor moving mass Mc and the number of windings in the housing. Since the mass of the housing Mh is a function of the number of windings, the force F can be expressed as $F=\alpha*Mh*Mc$, where $\alpha$ is a constant. Substituting in this restriction into the equations of motion (equation 1) with the restriction that the system must have a contactor resonance at 250 Hz, for a range of vibrotactile transducer total masses and contactor masses results in maximum contactor displacement for a contactor mass that is between 20 and 40% of the total mass, and most preferably 27% of the total mass for a contactor of 0.8 cm diameter and a housing of 2.8 cm in diameter.

Figure 6:
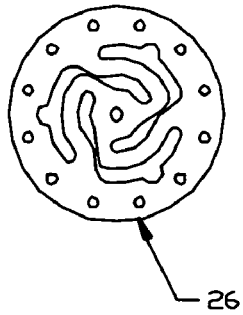
FIG. 6 is a plan view of a planar spring that may be used in the transducer apparatus.

FIG. 6 is a plan view of a planar spring 26 that may be used in the transducer apparatus. Design of the circular planar spring 26 exhibits low compliance (high stiffness) in a plane parallel to the spring, and a high mechanical compliance (low stiffness) in a plane perpendicular to the spring. The springs serve to suspend the magnet/contactor assembly concentric to the coil assembly, and provide a controlled mechanical compliance in the perpendicular direction (direction of motion) so that when the contactor and housing face is pressed against the skin of the user, the contactor and magnet assembly are displaced with respect to the housing to simultaneously preload the contactor against the skin and the contactor/magnet assembly against the action of the spring. The compliance of the spring in the perpendicular direction together with the compliance of the skin under the contactor face also serves to set the mechanical resonance frequency of the transducer when applied to the skin, as described previously.

The complex magnetic interaction in the tactor 10 operation is especially important in the consideration of the leaf-spring design. A transverse magnetic force exists between the centered permanent magnet and the steel coil ring—this could cause the magnet to displace towards the coil if it were not held in place (laterally) by the spring. Additionally, if the spring did not control/limit the axial motion, the static field could force the magnet to some position other than the centered position in the assembly. The dynamic (ac) force on the magnet results from the interaction of the magnet with the field generated by the current flowing in the coils, and is the desirable driving force that causes the magnet to oscillate in the axial direction. Thus the planar spring design plays a crucial role in the functioning of the tactor, centering the contactor, allowing displacement along the preferred axis of motion and with a necessary spring stiffness to achieve desired oscillations.

Figure 7A:
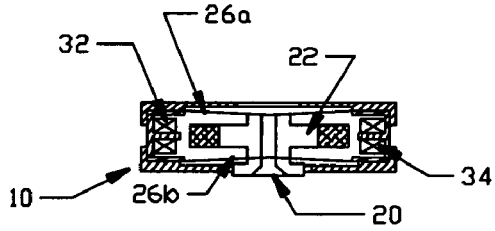
FIGS. 7A-7C are a series of side elevation cross-sectional views of the transducer of FIG. 2 illustrating the magnet assembly and contactor in various stages of reciprocating motion.
Figure 7B:
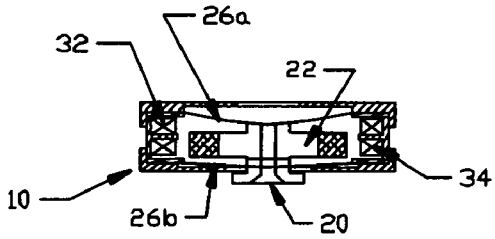
Figure 7C:
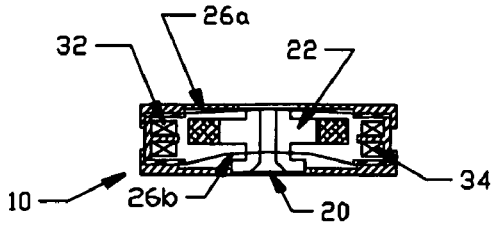

FIGS. 7A-7C are a series of side elevation cross-sectional views of the transducer of FIG. 2 illustrating the magnet assembly and contactor in various stages of reciprocating motion. When an alternating current is applied to the pair of coils 32, 34 by an external power source, the electromagnet field interacts with the magnetic field which causes the magnet assembly 22 and contactor 20 to move about the neutral axis (FIG. 7A). On the positive half cycle (FIG. 7B), the magnet assembly 22 moves forward depressing the face of the contactor 20 from its neutral, preloaded position further into the skin. On the negative half cycle (FIG. 7C), the face of the contactor 20 pulls away from the skin. During these cycles the housing, acting as the reaction mass, moves in the opposite direction to that magnet assembly and contactor, with reduced amplitude. The drive signal is typically sinusoidal, but can be other shapes such as a square wave, triangular wave or others. This alternating motion of the contactor against the user's skin or clothing causes a vibrational stimulus to be applied to a person's body which is in contact with the transducer.

In order to provide information via a vibrotatile device, it is desirable to be able to offer a variety of tactile stimuli other than just an on (the device oscillating) and off (the device at rest) condition. Parameters that can be changed are the waveshape (for example sine wave, square wave, triangle wave), the oscillation frequency and the oscillation displacement (intensity). For example, the intensity can be lowered to half power to indicate a less urgent condition, and two different frequencies can be used to communicate two different conditions that need the user's attention. However, the ability of the body's skin receptors to discriminate different intensity and frequency vibration stimuli is quite limited, so that to be practical, large differences are required. This limits the usefulness of intensity (amplitude) and frequency modulation techniques to convey information.

A more discernable modulation technique is a pulse or tone burst modulation where, for example, the device is controlled to oscillate at 250 Hz for 200 ms, and then switched off for 200 ms, and this on-off sequence is repeated. In this way, a fast modulation of the tactor (e.g., a 200 ms, 250 Hz sine wave tone burst repeated every 200 ms) can be used to convey urgency, and slow modulation (e.g., a 200 ms, 250 Hz sine wave tone burst repeated every 1 second) can be used to convey a low priority incident.

Another option is to use two distinct and clearly differentiable frequencies, for example a low frequency, say 30 Hz to indicate a low priority event, and a high frequency, say 250 Hz to convey a high priority event. The vibrotactile transducer of this invention is capable of responding to an electrical input at these two frequencies but its electromechanical efficiency is typically optimized for operation over a smaller frequency range (200 to 300 Hz).

A suitable approach to achieving a low frequency sensation using a higher frequency transducer is to introduce amplitude modulation of the drive signal to the tactor. For example the resonance frequency of the preferred embodiment of the vibrotactile transducer when loaded into the skin is approximately 250 Hz. This can be considered to be the "carrier" frequency. A frequency of 50 Hz translates to a period of 20 mS. An ON-OFF modulation of the tactor (with a sine or square wave) at 20 mS would in theory result in a low frequency modulated signal. This process is well known in prior art as AM modulation and can be easily performed using a suitable signal generator. Actually the low frequency modulated signal would now contain the carrier and components of the 50 Hz (square wave) modulated signal. When this modulated signal is applied to the non-linear human mechanoreception system, the low frequency sensation is in fact easily perceived or detected by the user. The is most likely because the channel independence in mechanoreception (Cholewiak and Collins, In M. A. Heller and W. R Schiff (Eds.), The Psychology of Touch, pp. 23-60, Hillsdale, N.J.: Lawrence Erlbaum Associates 1992) separate the high and low frequency components and the skin sensor process is able to demodulate (envelope detect) the input modulated waveform.

Figure 8A:
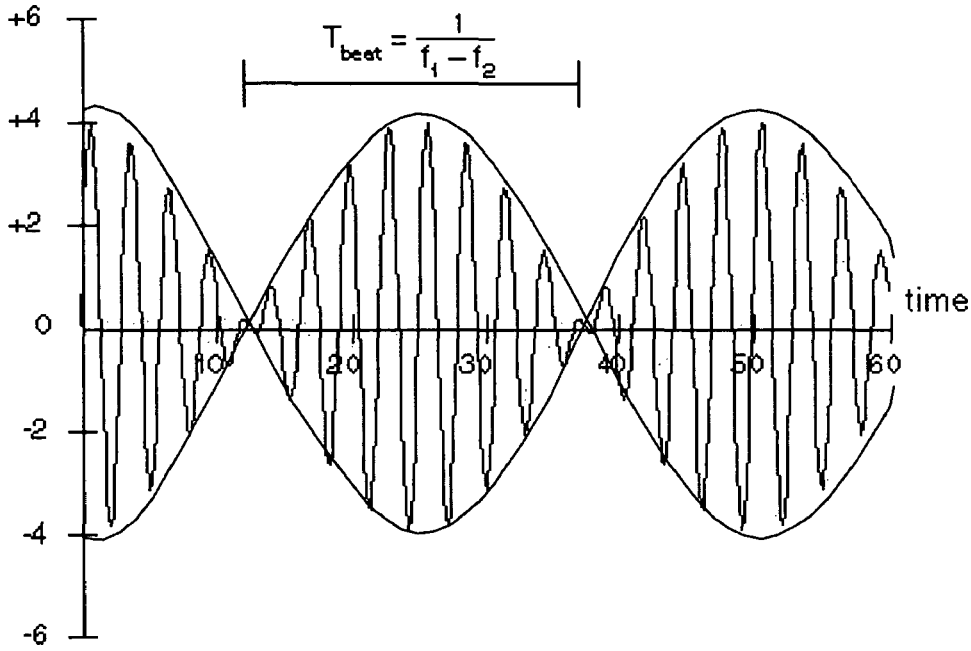
FIG. 8A shows the summation of two sinusoidal frequencies with slightly different frequencies f1 and f2, but the same amplitudes, and the envelope of the resultant signal.

A more effective scheme can be implemented when two closely spaced sinusoidal signals are linearly summed together. This process is known as mixing, and results in the generation of a "beat frequency" whose envelope has a low frequency resultant waveform with a frequency equal to the difference between the two applied signals. FIG. 8A shows the summation of two sinusoidal frequencies with slightly different frequencies f1 and f2, but the same amplitudes. When the two signals are linearly summed together there is constructive interference (the two signal add in phase) resulting in a signal maximum, and destructive interference (the two signal add out of phase) resulting in signal cancellation. The envelope of this signal can be detected (demodulated) and would be seen as a sinusoidal signal with frequency equal to the difference between the two summed signals.

Figure 8B:
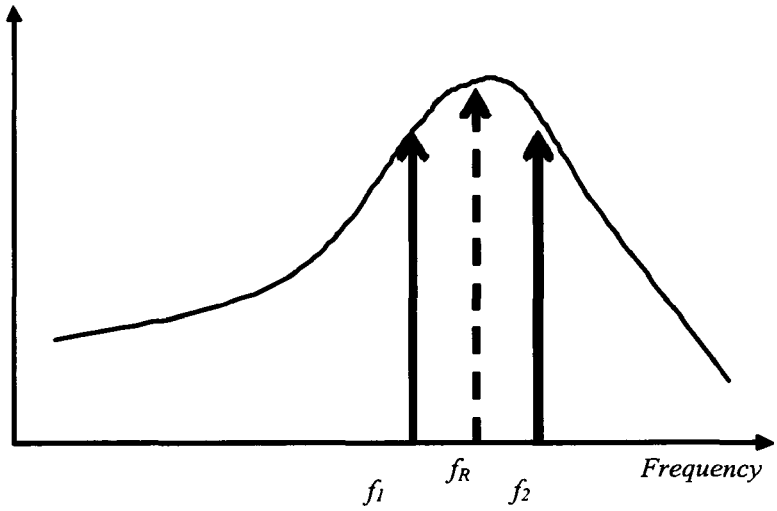
FIG. 8B shows a depiction of the magnitude of the frequency spectrum of the vibrotactile transducer and the two frequency tones which are typically selected to be equally spaced on each side of the primary resonance fr.

When we apply two frequencies $f_1$ and $f_2$ the amplitude variation occurs at the beat frequency, given by the difference between the two sinusodial frequencies: $f_{beat}=f_1-f_2$. In the preferred embodiment the two frequency tones are typically selected to be equally spaced on each side of the primary resonance fr, as shown in FIG. 8B. This approach leads to the most efficient use of the spectrum; the spectrum consists of only two spectral components which are very close to the resonance of the vibrotactile transducer and corresponds to the most efficient operation of the device. For this low frequency signal envelope to be easily perceived by the human mechanoreception system, the difference in frequency between the two sinusoidal signals should be between 0.1 and 70 Hz and the individual sinusoidal signals be above 150 Hz so as to out of the band of the skin's low frequency reception channel. For the subject vibrotactile transducer embodiment, the best results are attained with the individual sinusoidal signal above 200 Hz, and more specifically equally spaced in frequency above and below about 250 Hz.

Figure 9A:
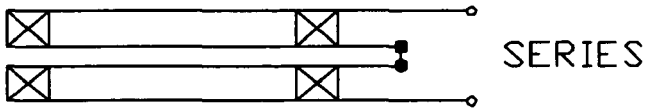
FIGS. 9A-9C are schematic views of alternative wiring to the coils of the transducer apparatus.
Figure 9B:
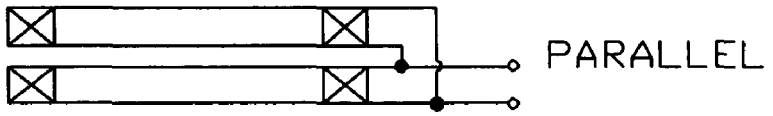
Figure 9C:
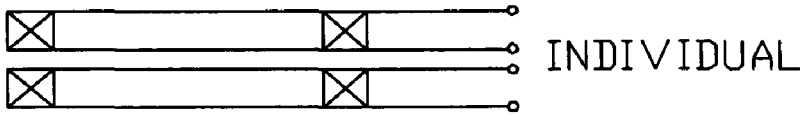
Figure 9D:
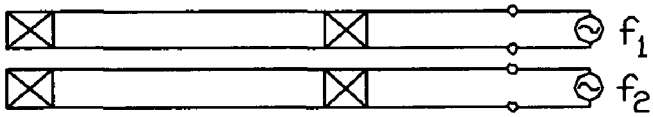
FIG. 9D shows signals of different frequencies applied to each coil separately.

This modulation technique can be readily applied to the subject vibrotactile transducer since it includes two separate stator coils that can be driven together or separately. FIGS. 9A-9C are schematic views of alternative wiring to the coils of the transducer apparatus. FIG. 9A illustrates a series connection, FIG. 9B a parallel connection, and FIG. 9C individual connections to the two coils. This latter configuration provides a convenient method to apply different frequencies (f1 and f2) to each coil as shown in FIG. 9D to achieve the frequency mixing described above to efficiently synthesize a low frequency vibrational stimulus. In this embodiment, the two frequencies sum magnetically and the resultant magnetic field causes the magnet assembly to oscillate such that the envelope of the resultant signal corresponds to the difference frequency of f1−f2. The ability to directly drive each coil individually in this manner can simplify the driving electronics and eliminated the generation of intermodulation distortion in electronic power amplifiers. Also, each amplifier will drive a constant waveform and need not be designed for a peaking factor or the ability to change in frequency or amplitude. This is advantageous in some applications in that low cost electronics may be used.

Another benefit of the dual coil configuration is that the different coil connections allow for different coil impedances to be selected. Coil impedances are nominally 24 ohms for series connection, 6 ohms for parallel connections, and 12 ohms for each individually. In conventional wiring arrangements, the two coils can be wired in series or parallel with attention to polarity so that when current is passed through the circuit, the coils induce additive forces that drive the magnet and contactor. This arrangement can be used to achieve two different coil impedances with 4:1 impedance ratio. This wiring arrangement makes it possible to use conventional linear and switching power amplifier circuits with the tactor. In alternative arrangement, the leads to both coils are made available to the power amplifier, making it possible to use new and evolving amplifier configurations that use toggling switches to drive each coil directly from the battery or supply voltage. The on/off time and drive current polarity to each coil can be controlled with greatly simplified timing circuitry compared to conventional switching amplifier configurations. This feature can ultimately improve efficiency and reduce amplifier size and heat generation by the amplifier and tactor.

The various coil configurations allow coil impedance to be optimized to maximize power flow from a power amplifier into the tactor, even when the system is powered by a low voltage battery. The preferred embodiment provides a tactor coil impedance that has been optimized for operation with a low voltage battery.

Figure 10:
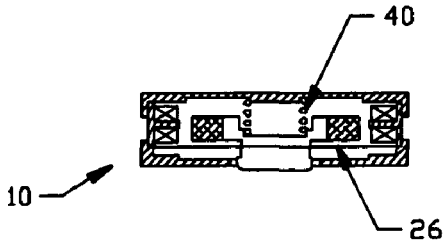
FIG. 10 is a side elevation cross-sectional view of a planar/coil spring alternative embodiment of a vibrotactile transducer.

FIG. 10 is a side elevation cross-sectional view of a planar/coil spring alternative embodiment of a vibrotactile transducer. In this embodiment a planar spring 26 is used as the centering element, and the spring constant is the combination of the individual spring constants of the planar spring 26 and a coil spring 40.

Figure 11:
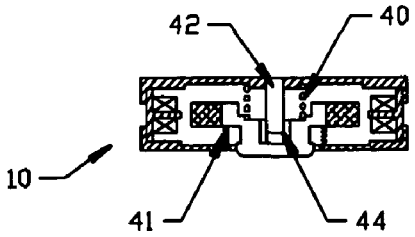
FIG. 11 is a side elevation cross-sectional view of a bearing/coil spring embodiment of a transducer.

FIG. 11 is a side elevation cross-sectional view of a bearing/coil spring embodiment of a transducer. In this embodiment, a shaft 42 is used as the centering element, and a low friction bearing 44 is used to guide the magnet/contactor assembly in the linear motion. The required spring constant is provided by one or more coil springs 40, 41. A single spring embodiment is also possible where spring 41 is omitted, and its compliance is effectively replaced by the compliance of the user's skin when the transducer is held in contact with the body.

A specific preferred embodiment of the inventive apparatus may have the following features:

| | |
|---|---|
| Physical Description: | 1.2" diameter by 0.31" high, 17 grams, anodized aluminum. |
| Electrical Wiring: | Flexible, insulated, #24 AWG. |
| Skin Contactor: | 0.3" diameter, raised 0.025", pre-loaded onto the skin. |
| Electrical Characteristics: | 7.0 ohms nominal. |
| Insulation Resistance: | 50 megohm minimum at 25 Vdc, leads to housing |
| Response Time: | 33 ms max. |
| Transducer Linearity: | +/− 1 dB from sensory threshold to 0.04" peak displacement |
| Recommended Drive: | Sine wave tone bursts 250 Hz at current levels to 0.25 A rms nominal, 0.5 A rms max. for short duration. |
| Recommended Driver: | Bipolar, linear or H-bridge class D switching amplifier, capable of providing at least 2 V rms, 0.5 A rms output. |
| Stimulus Amplitude: | >.025" pk at 230 Hz with 0.25 A rms drive |

Figure 12:
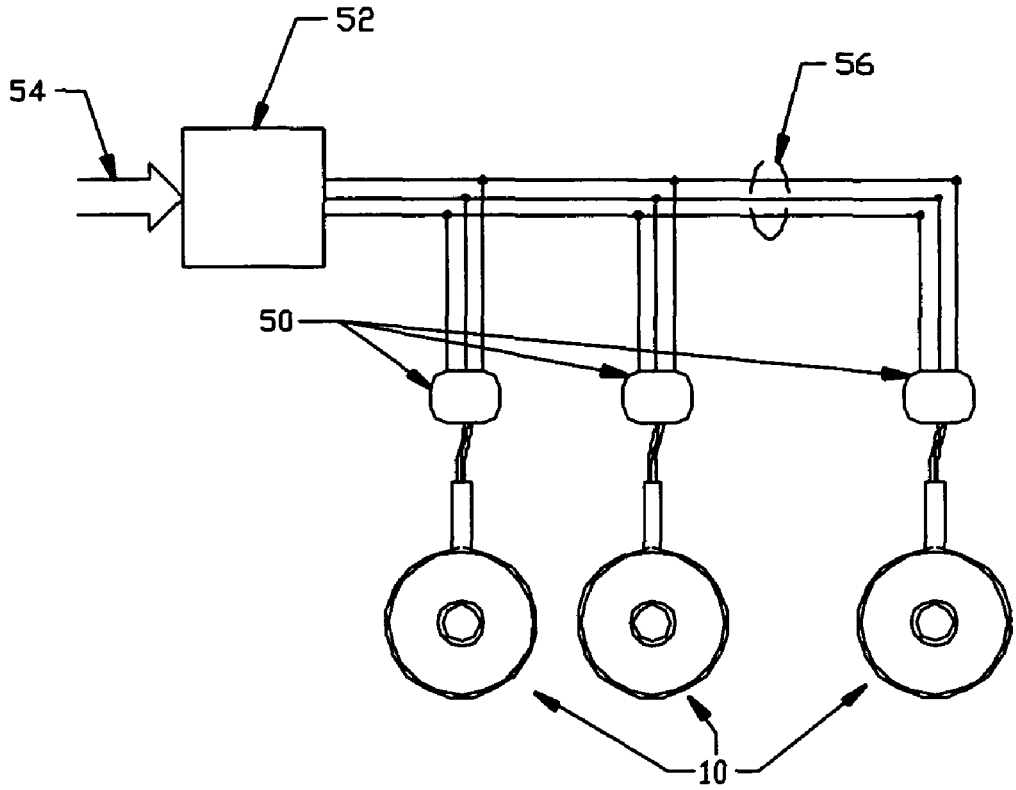
FIG. 12 is a schematic view of multiple transducers with co-located addressable microcontroller/drivers on a three wire wiring harness/bus.

FIG. 12 is a schematic view of multiple transducers with co-located addressable microcontroller/drivers on a three wire wiring harness/bus. In this configuration, the power source 50 is miniaturized and co-located with the vibrotactile transducer. The power source preferably includes an addressable microcontroller, a programmable oscillator, and a unipolar or bipolar switching amplifier. A master module 52, capable of being interfaced to a computer via digital control lines 54 can control a number of vibrotactile transducers simultaneously. The master module provides power to the microcontroller/driver and is able to address each microcontroller using conventional logic signal levels, and provide a switch on and switch off command. It is also able to program a unique address and frequency to each power source. A number of vibrotactile devices (e.g., up to 64 or more) can be attached to a three conductor electrical wiring harness 56, and addressed individually or in groups. In an alternative embodiment, a two conductor electrical wiring harness can be used, where the power and digital control signal share one conductor. This arrangement greatly reduces the electrical wiring requirement, as it reduces the wiring required from n×2 (where n=number of tactors) to just two or three for many tactors, regardless of the number of tactors connected.

In an alternative embodiment, the master module can be omitted, and the microcontroller in the addressable microcontroller/driver module can be configured to communicate directly with a computer or controller via a standard serial multi-drop bus such as USB or RS 488.

Figure 13:
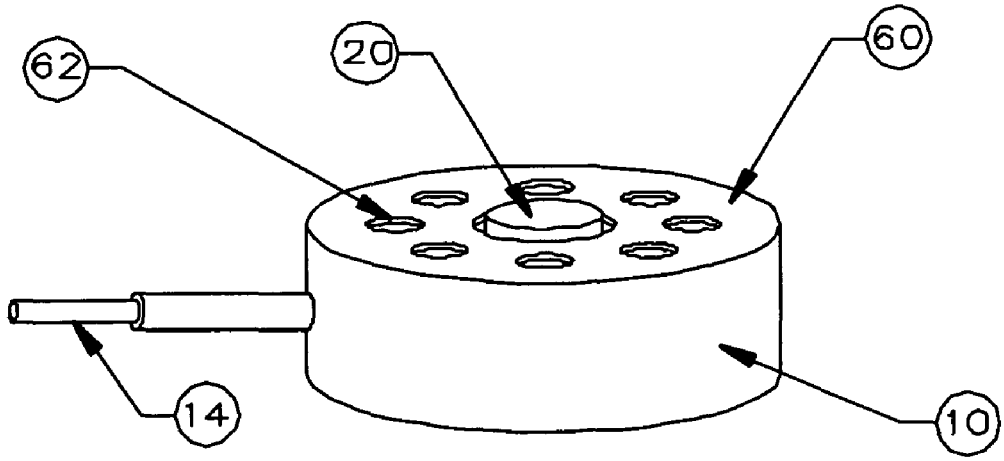
FIG. 13 is a perspective view of a free-flooding embodiment of the transducer of this invention suitable for underwater operation.

FIG. 13 is a perspective view of a free-flooding embodiment of the transducer of this invention suitable for underwater operation. The inventive apparatus can be adapted for use underwater by divers for navigation, training and communications. A conventional approach to waterproofing would be to seal the unit with flexible diaphragms, and fill with oil or a similar dielectric fluid so that the mechanism is pressure balanced to the external water pressure. The problem with this approach is that the flexible diaphragm and fill fluid damps the response, thus reducing the displacement, and increasing the mass of the moving components, lowering the resonance frequency. It also introduces non-linearities which may degrade performance. FIG. 13 shows the preferred embodiment for the invention suitable for underwater vibrotactile operation. The underwater housing 60 has a series of holes 62 placed on the top and bottom side, venting the interior mechanism and allowing fluid to free flood into the device. A thin, non-corrosive coating is applied to internal steel parts to prevent corrosion, and electrical wiring 14 is properly insulated and water blocked using conventional epoxy sealants to prevent degradation of electrical characteristics. By allowing fluid (water) to flow freely in and out of the interior of the mechanism, the tactor is able to operate in unlimited depth water with minimal degradation to performance and since the fluid in the interior is not trapped within the mechanism, and there is minimal fluid mass and frictional damping. In this embodiment, the area of the vent holes should be between 8 and 15% of the housing area for effective vibrotactile operation. Preferably, holes should be larger than 3 mm in diameter to avoid high acoustic losses that would degrade tactor performance. In a specific example of this embodiment of the invention, a 32 mm diameter tactor housing was perforated with six 3.7 mm diameter holes.

Accordingly, the invention may be characterized as a vibrotactile transducer used to provide a vibrational stimulus to the body of the user in response to an electrical input, including a housing having a skin contacting face with an opening in it; a toroidal moving magnetic assembly; at least one spring suspending the assembly in the housing; a mechanical contactor connected to the magnet assembly for movement therewith, the contactor, in its rest position, protruding from the housing face though the opening whereby, when the housing face is pressed against the skin of the user, the contactor and magnet assembly are displaced with respect to the housing to pre-load the contactor and magnet assembly against the action of the spring, the range of movement of the contactor being such that once pre-loaded it vibrates between a retracted position within the housing and an extended position in which it is in contact with the skin of the user through the opening; a radial gap between the contactor and a face of the housing which bounds the opening; and a magnetic circuit including a pair of electrical coils connected in a push-pull configuration whereby magnetic fields induced by current flowing in the coils vibrates the magnetic assembly and the mechanical contactor.

Alternatively, the invention may be characterized as a vibrotactile transducer used to provide a vibrational stimulus to the body of the user in response to an electrical input, including a housing having a skin contacting face with an opening in it; a toroidal moving magnetic assembly; at least one spring suspending the assembly in the housing and a mechanical contactor connected to the magnet assembly for movement therewith and positioned in the opening for vibratory movement through the opening, the range of movement of the contactor being such that it vibrates between a retracted position within the housing and an extended position in which it is in contact with a zone of the skin of the user through the opening, the zone being encircled by the face.

In either characterization, the mass of the moving contactor assembly, the mass of the housing, the compliance of the skin load on the contactor face and housing face, and the compliance of the spring in the direction of motion are preferably chosen so that the electromechanical resonance of the motional masses, when loaded by a typical skin site on the human body, are in a frequency band where the human body is most sensitive to vibrational stimuli.

In the preferred embodiment, the area of said skin contacting face of the moving mechanical contactor is between about 0.1 cm sq. and 2 cm sq., the ratio of the mass of the mechanical contactor to the total mass of the transducer including the contactor, lies in the range 1:5 to 2:5. The vibrotactile transducer preferably includes means for applying a carrier signal to the coils for vibrating the moving magnetic assembly and the contactor at a frequency of between about 200 Hz and about 300 Hz, and for generating a signal which modulates the carrier signal at a frequency of between about 1 Hz and about 70 Hz. The tactor also preferably includes means for selectively applying signals to the coils to vibrate the assembly and the contactor at a first frequency and at a second different frequency. The tactor may include a plurality of holes in the housing to allow flooding of the housing upon the transducer being immersed in a liquid, wherein the holes cover between about 8% and 15% of the area of the front and rear faces of the transducer. A plurality of tactors may be used with means for vibrating the tactors at different frequencies, intensities and/or amplitudes and at different times whereby different parts of the user's body can be stimulated in different ways.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. Therefore, the above description and illustrations should not be construed as limiting the scope of the invention, which is defined by the appended claims.

What is claimed as invention is:

1. A vibrotactile transducer to provide a vibrational stimulus to a body of a user in response to an electrical input, said vibrotactile transducer comprising:

a substantially cylindrical housing having a substantially circular contacting face, said contacting face defining an opening passing therethrough, said housing being defined by a height of said housing and a diameter of said contacting face, said diameter being greater than said height;

a moving magnetic assembly;

at least one spring suspending said assembly in said housing;

a mechanical contactor connected to said magnet assembly for movement therewith, a gap being defined around said contactor between said contactor and said housing when said contactor is positioned in said opening, said contactor and said contacting face of said housing being simultaneously positionable against a surface associated with a user, wherein when said contactor is positioned against said user surface, said contactor and said magnet assembly are retracted with respect to said housing to pre-load said contactor and magnet assembly against the action of the said spring; and a magnetic circuit attached to said housing, said magnetic circuit including electrical coils connected in a push-pull configuration whereby magnetic fields induced by current flowing in said coils vibrates said magnetic assembly, said contactor, and said housing, wherein said contactor vibrates within the opening of the housing to provide a contactor vibration to said user surface, and said housing vibrates to provide a housing vibration, said housing vibration being at a reduced level and substantially out of phase relative to said contactor vibration.

2. The vibrotactile transducer of claim 1 wherein said diameter of said contacting face is at least approximately 4 times greater than said height of said housing.

3. The vibrotactile transducer of claim 1 wherein said contactor protrudes relative to said contacting face by approximately 1 mm when said contactor and said magnet assembly are not retracted with respect to said housing.

4. The vibrotactile transducer of claim 1 wherein said coils receive a carrier signal that causes said moving magnetic assembly and said contactor to vibrate at a frequency of between 200 Hz and 300 Hz, the carrier signal being modulated at a frequency of between 0.1 Hz and 70 Hz.

5. The vibrotactile transducer of claim 1 including means for selectively applying signals to said coils to vibrate said assembly and said contactor at a first frequency and at a second frequency, the first and second frequencies being different to one another.

6. The vibrotactile transducer of claim 1 wherein said vibrotactile transducer is less than approximately 100 grams.

7. A vibrotactile transducer to provide a vibrational stimulus to a body of a user in response to an electrical input, said vibrotactile transducer comprising;

a housing having a contacting face with an opening; a moving magnetic assembly; at least one spring suspending said assembly in said housing;

a mechanical contactor connected to said magnet assembly for movement therewith, a gap being defined around said contactor between said contactor and said housing when said contactor is positioned in said opening, said contactor and said contacting face of said housing being simultaneously positionable against a surface associated with a user, wherein when said contactor is positioned against said user surface, said contactor and magnet assembly are retracted with respect to said housing to preload said contactor and magnet assembly against the action of said spring; and a magnetic circuit attached to said housing, said magnetic circuit including electrical coils connected in a push-pull configuration whereby magnetic fields induced by current flowing in said coils vibrates said magnetic assembly said contactor, and said housing, wherein said contactor vibrates within the opening of the housing to provide a contactor vibration to said user surface, said housing vibrates to provide a housing vibration, said housing vibration being at a reduced level and substantially out of phase relative to said contactor vibration, and a mass of said contactor and said magnetic assembly is approximately 20% to 40% of a total mass of said transducer.

8. The vibrotactile transducer of claim 7 wherein said vibrotactile transducer is less than approximately 100 grams.

9. The vibrotactile transducer of claim 7 wherein said coils receive a carrier signal that causes said moving magnetic assembly and said contactor to vibrate at a frequency of between 200 Hz and 300 Hz, the carrier signal being modulated at a frequency of between 0.1 Hz and 70 Hz.

10. The vibrotactile transducer of claim 7 including means for selectively applying signals to said coils to vibrate said assembly and said contactor at a first frequency and at a second frequency, the first and second frequencies being different to one another.

11. The vibrotactile transducer of claim 7 wherein said mass of said contactor and said magnetic assembly, a mass of said housing, an area of a contactor face and an area of the housing face corresponding to a load compliance of said user surface, and a mechanical compliance of said spring are configured so that the electromechanical resonance of said contactor assembly and said magnetic assembly, when loaded by said user surface, are in a frequency band where said user surface is most sensitive to vibrational stimuli.

12. A method for providing a vibrational stimulus to a body of a user in response to an electrical input, said method comprising the steps of:

providing a vibrotactile transducer having a substantially cylindrical housing with a substantially circular contacting face with an opening passing therethrough, said housing being defined by a height of said housing and a diameter of said contacting face, said diameter being greater than said height, a moving magnetic assembly, at least one spring suspending the assembly in said housing, a mechanical contactor connected to said magnetic assembly for movement therewith and positioned in said opening for vibratory movement through said opening, a gap being defined around said contactor between said contactor and said housing when said contactor is positioned in said opening, and a magnetic circuit attached to said housing, said magnetic circuit including electrical coils connected in a push-pull configuration whereby magnetic fields induced by current flowing in said coils vibrates said magnetic assembly, said contactor, and said housing;

positioning said contacting face and said mechanical contactor simultaneously against a surface associated with a user, causing said mechanical contactor to retract within said opening; and operating said magnetic circuit and vibrating the magnetic assembly and the mechanical contactor, said contactor vibrating within the opening of the housing to provide a contactor vibration to said user surface, and said housing vibrating to provide a housing vibration, said housing vibration being at a reduced level and substantially out of phase relative to said contactor vibration.

13. The method of claim 12 further including the step of applying a carrier signal to the coils for vibrating said moving magnetic assembly and the contactor at a frequency of between 200 Hz and 300 Hz, the carrier signal being modulated at a frequency of between 0.1 Hz and 70 Hz.

14. The method of claim 12 further including the step of selectively applying signals to the coils to vibrate the assembly and the contactor at a first frequency and at a second frequency, the first and second frequencies being different to one another.

15. The method of claim 12 wherein said diameter of said contacting face is at least approximately 4 times greater than said height of said housing.

16. The method of claim 12 further including the step of providing a plurality of vibrotactile transducers, and vibrating the contactors at different intensities and at different times whereby different parts of the user's body can be stimulated in different ways.

17. The method of claim 12 further including the step of choosing a mass of said contactor and said magnetic assembly, a mass of the housing, an area of a contactor face and an area of the housing contacting face corresponding to a load compliance of said user surface, and a mechanical compliance of said spring so that the electromechanical resonance of the motional masses, when loaded by said user surface on the human body; are in a frequency band where the human body is most sensitive to vibrational stimuli.

18. The vibrotactile transducer of claim 1, wherein said height is less than approximately 1.25 cm.

19. The vibrotactile transducer of claim 1, wherein said diameter of said contacting face is less than approximately 5 cm.

20. The vibrotactile transducer of claim 1, wherein said contactor has a diameter approximately between 0.75 cm and 1.25 cm.

21. The vibrotactile transducer of claim 1, wherein a mass of said contactor and said magnetic assembly, a mass of said housing, an area of the contactor face and an area of the housing face corresponding to a load compliance of said user surface, and a mechanical compliance of said spring are configured so that the electromechanical resonance of said contactor assembly and said magnetic assembly, when loaded by said user surface, are in a frequency band where said user surface is most sensitive to vibrational stimuli.

22. A wearable device comprising a plurality of vibrotactile transducers mounted on said wearable device, said vibrotactile transducers providing a vibrational stimulus to a body of a user in response to an electrical input, each of said vibrotactile transducers comprising:

a substantially cylindrical housing having a substantially circular contacting face, said contacting face defining an opening passing therethrough, said housing being defined by a height of said housing and a diameter of said contacting face, said diameter being greater than said height;

a moving magnetic assembly;

at least one spring suspending said assembly in said housing;

a mechanical contactor connected to said magnet assembly for movement therewith, a gap being defined around said contactor between said contactor and said housing when said contactor is positioned in said opening, said contactor and said contacting face of said housing being simultaneously positionable against a surface associated with a user, wherein when said contactor is positioned against said user surface, said contactor and magnet assembly are retracted with respect to said housing to pre-load said contactor and magnet assembly against the action of said spring; and a magnetic circuit attached to said housing, said magnetic circuit including electrical coils connected in a push-pull configuration whereby magnetic fields induced by current flowing in said coils vibrates said magnetic assembly, said contactor, and said housing, wherein said contactor vibrates within the opening of the housing to provide a contactor vibration to said user surface, and said housing vibrates to provide a housing vibration, said housing vibration being at a reduced level and substantially out of phase relative to said contactor vibration.

23. The wearable device of claim 22, wherein said diameter of said contacting face is at least approximately 4 times greater than said height of said housing.

24. The wearable device of claim 22, wherein said contactor protrudes relative to said contacting face by approximately 1 mm when said contactor and said magnet assembly are not retracted with respect to said housing.

25. The wearable device of claim 22, wherein said height is less than approximately 1.25 cm.

26. The wearable device of claim 22, wherein said diameter of said contacting face is less than approximately 5 em.

27. The wearable device of claim 22, wherein each vibrotactile transducer is less than approximately 100 grams.

28. The wearable device of claim 22, wherein said wearable device is a belt or clothes.

29. The wearable device of claim 22, further comprising means for vibrating said plurality of vibrotactile transducers at different frequencies and at different times whereby different parts of the user's body can be stimulated in different ways.

30. The vibrotactile transducer of claim 1, wherein said vibrotactile transducer is in electrical communication with a controller/driver, wherein said controller/driver supplies a predefined electrical drive current to said vibrotactile transducer.

31. The vibrotactile transducer of claim 7 wherein said vibrotactile transducer is in electrical communication with a controller/driver, wherein said controller/driver supplies a predefined electrical drive current to said vibrotactile transducer.

32. The vibrotactile transducer of claim 22 wherein said vibrotactile transducer is in electrical communication with a controller/driver, wherein said controller/driver supplies a predefined electrical drive current to said vibrotactile transducer.

* * * * *